US005969466A

United States Patent [19]

Dibianca

[11] Patent Number: 5,969,466

[45] Date of Patent: Oct. 19, 1999

[54] PERFORMANCE SPARK PLUG

[76] Inventor: John Dibianca, 2103 SW. Bridge Rd., Stuart, Fla. 34997

[21] Appl. No.: 09/095,958

[22] Filed: Jun. 11, 1998

[51] Int. Cl.[6] ..... H01T 1/22

[52] U.S. Cl. ..... 313/139; 313/141

[58] Field of Search ..... 313/139, 141, 313/142

[56] References Cited

U.S. PATENT DOCUMENTS

| | | | |
|---|---|---|---|
| 4,023,058 | 5/1977 | Lara et al. | 313/139 |
| 5,202,601 | 4/1993 | Takamura et al. | 313/142 |
| 5,406,166 | 4/1995 | Abe et al. | 313/142 |
| 5,430,346 | 7/1995 | Johnson | 313/139 |

*Primary Examiner*—Michael Day
*Attorney, Agent, or Firm*—Kevin Redmond

[57] ABSTRACT

A spark plug includes a ground electrode and a center electrode. The ground electrode comprises a ring shaped member which is centered on the center electrode. A beveled ring shaped surface of the ring shaped member generally faces the center electrode. This increases the spark area of the ground electrode, providing for more consistent and stronger sparks, and even multiple sparks. A cross shaped channel is disposed centrally on a distal face of the center electrode. Because of the increased spark area which the channel provides, the spark is more likely to travel along the channel, rather than jump from point to point along the distal face of the center electrode, as can happen with conventional spark plugs; thus, the channel provides a stronger and more consistent spark.

4 Claims, 2 Drawing Sheets

PERFORMANCE SPARK PLUG

BACKGROUND OF THE INVENTION

1. Field of the Invention

The present invention relates to spark plugs.

2. Description of the Related Art

In order to provide the greatest possible fuel economy, performance, and power, it is important for spark plugs to fire consistently, and to provide strong sparks.

New types of spark plugs have been developed which try to provide stronger sparks and more consistent firing. U.S. Pat. No. 5,430,346 to Johnson provides a spark plug with a generally ring shaped ground electrode. This provides greater spark area compared to a conventional ground electrode, and provides multiple paths which the spark can follow between the center electrode and the ground electrode. These features contribute to stronger sparks and more consistent firing.

SUMMARY OF THE INVENTION

The improved performance spark plug of the present invention includes a ground electrode and a center electrode. The ground electrode comprises a ring shaped member which is centered on the center electrode. A beveled ring shaped surface of the ring shaped member generally faces the center electrode. This increases the spark area of the ground electrode, providing for more consistent and stronger sparks, and even multiple sparks.

A cross shaped channel is disposed centrally on a distal face of the center electrode. Because of the increased spark area which the channel provides, the spark is more likely to travel along the channel, rather than jump from point to point along the distal face of the center electrode, as can happen with conventional spark plugs; thus, the channel provides a stronger and more consistent spark.

Still further features and advantages will become apparent from the ensuing description and drawings.

DETAILED DESCRIPTION

Figure 1:
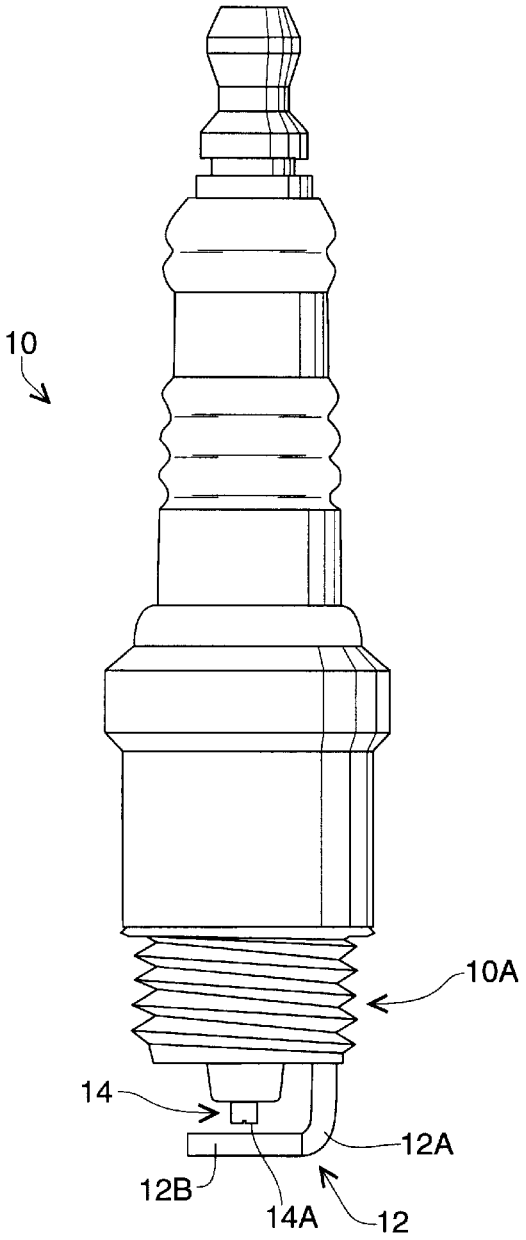
FIG. 1 is an elevational view of an improved performance spark plug of the present invention.

FIG. 1 is an elevational view of an improved performance spark plug 10 of the present invention, having a mounting end 10A designed to be mounted to a cylinder head (not shown) such that a ground electrode 12 and a center electrode 14 are disposed within a combustion chamber (not shown) of the cylinder head (not shown) in a conventional manner.

Figure 2:
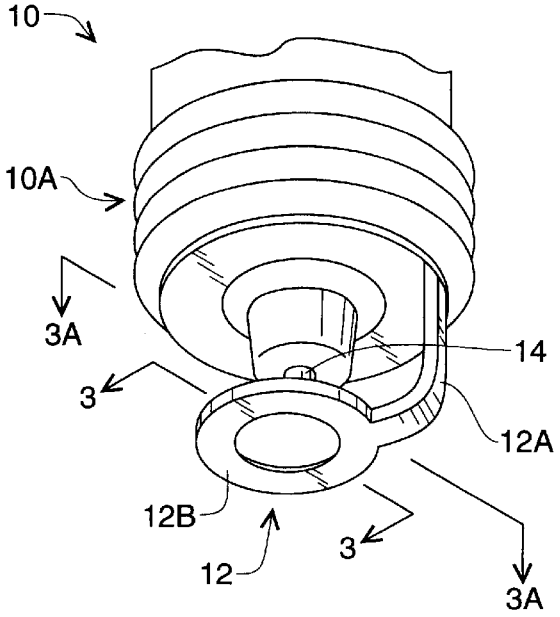
FIG. 2 is a partial perspective view of the spark plug, showing the ground and center electrodes.

FIG. 2 is a partial perspective view of the spark plug 10, showing the ground and center electrodes 12, 14. The ground electrode 12 comprises a leg 12A extending outward from the mounting end 10A of the spark plug 10. A ring shaped member 12B is disposed at a distal end of the leg 12A.

Figure 3:
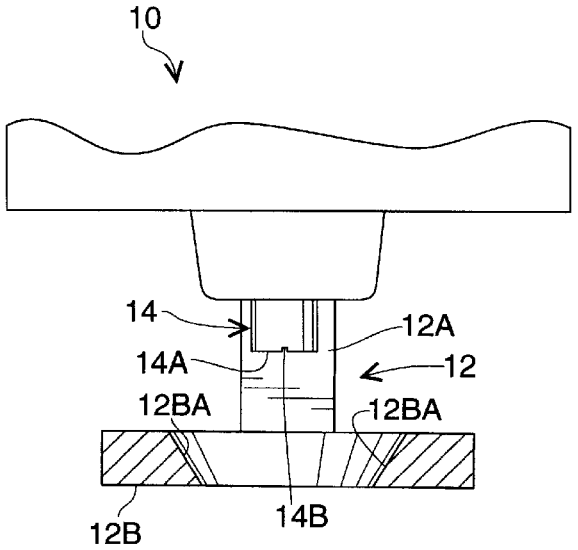
FIG. 3 is a cross-sectional view taken along line 3—3 of FIG. 2.
Figure 3A:
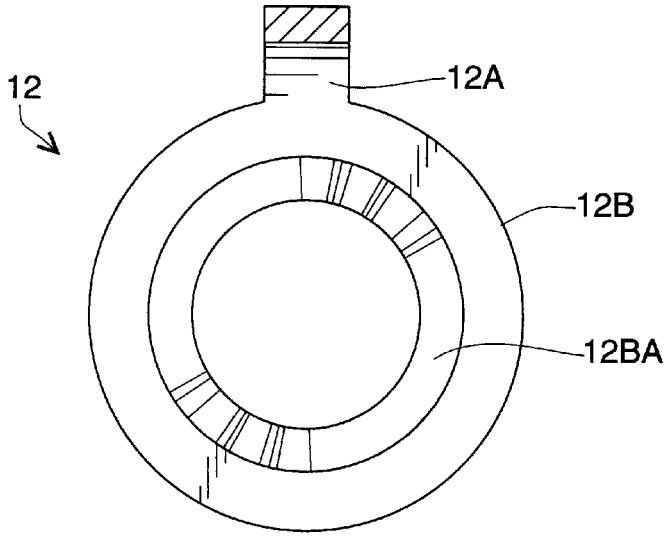
FIG. 3A is a cross-sectional view taken along line 3A—3A of FIG. 2.

FIG. 3 is a cross-sectional view taken along line 3—3 of FIG. 2. FIG. 3A is a cross-sectional view taken along line 3A—3A of FIG. 2. Referring to FIGS. 3 and 3A, the ring shaped member 12B is centered on the center electrode 14. A concave beveled ring shaped surface 12AB within the ring opening in the ring shaped member 12B is centered about and generally faces the center electrode 14. This increases the spark area of the ground electrode 12, providing for more consistent and stronger sparks (not shown), and even multiple sparks.

Figure 4:
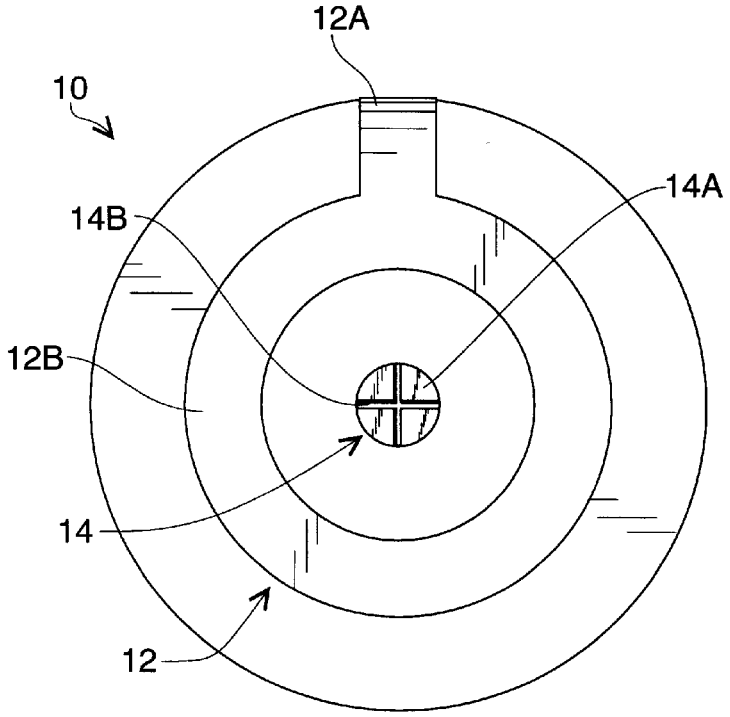
FIG. 4 is a bottom plan view of the spark plug, showing the distal face of the center electrode.

FIG. 4 is a bottom plan view of the spark plug 10, showing a distal face 14A of the center electrode 14. A cross shaped channel 14B is disposed centrally on the distal face 14A of the center electrode 14. Because of the increased spark area which the channel 14B provides, the spark (not shown) is more likely to travel along the channel 14B, and not to jump randomly from point to point across the distal face 14A of the center electrode 14. This jumping of the spark which can occur in conventional electrodes can weaken or kill the spark.

Thus, the spark plug of the present invention provides greater spark area, and decreases jumping of the spark along the center electrode. These features contribute to more consistent firing and stronger sparks.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. Accordingly, the scope of the invention is to be limited only by the following claims and their legal equivalents.

The invention claimed is:

1. A spark plug comprising a ground electrode, and a center electrode having a cross shaped channel generally centrally disposed on a distal face of the center electrode, said ground electrode including a generally ring shaped member with an opening generally centered with respect to the center electrode and the generally ring shaped member including a ring shaped surface having a concave bevel within said opening in said ring shaped member which generally faces said center electrode.

2. The spark plug of claim 1, wherein the center electrode includes a channel disposed on the distal face of the center electrode.

3. The spark plug of claim 2, wherein the channel is generally cross-shaped and is disposed generally centrally on the distal face of the center electrode.

4. A spark plug having a mounting end adapted to a cylinder head, the spark plug comprising:

a. a center electrode disposed on the mounting end;

b. ground electrode disposed on the mounting end;

c. the ground electrode having a ring shaped member with a central opening which is centered with respect to the central electrode;

d. the ring shaped member including a concave beveled ring shaped surface within the central opening within the ground electrode which faces the center electrode; and e. the center electrode including a cross-shaped channel disposed centrally on a distal face of the center electrode.

* * * * *